United States Patent [19]

Waldron

[11] Patent Number: 4,803,852

[45] Date of Patent: Feb. 14, 1989

[54] EARRING DEVICE FOR SUSPENDING A VARIETY OF CHARMS OR THE LIKE

[76] Inventor: Fay L. Waldron, 5124 Reynosa Dr., St. Louis, Mo. 63128

[21] Appl. No.: 19,762

[22] Filed: Feb. 27, 1987

[51] Int. Cl.[4] ..... A44C 7/00

[52] U.S. Cl. ..... 63/13; 63/29.1

[58] Field of Search ..... 63/12, 13, 14 R, 14 A, 63/29 R, 29 M

[56] References Cited

U.S. PATENT DOCUMENTS

| | | | |
|---|---|---|---|
| 2,629,989 | 3/1953 | McDonald | 63/13 |
| 2,797,561 | 7/1957 | Vaughn | 63/13 |
| 3,071,938 | 1/1963 | Davidson | 63/13 |
| 4,086,786 | 5/1978 | Ritter | 63/13 |

FOREIGN PATENT DOCUMENTS

| | | | |
|---|---|---|---|
| 147425 | 11/1920 | United Kingdom | 63/12 |

*Primary Examiner*—Richard J. Johnson

*Attorney, Agent, or Firm*—Senniger, Powers, Leavitt and Roedel

[57] ABSTRACT

An earring for suspending any of a variety of charms or the like therefrom. The earring comprises a loop member and a mechanism on the backside of the loop member for attaching the loop member to an ear. The loop member has a generally narrow throat adapted for allowing a link of a charm to be pulled therethrough to attach or detach the charm to the earring, the throat being positioned along the loop member generally adjacent the attaching mechanism so that the throat is closed by the ear of the wearer when the earring is attached to the ear, thereby to secure the charm to the loop. Also disclosed is such an earring having a loop member spring-biased from an open position wherein the link of a charm may be passed through the throat toward a closed position wherein the throat is narrower than the link of a charm thereby to secure the charm to the loop member.

13 Claims, 1 Drawing Sheet

FIG. 1.
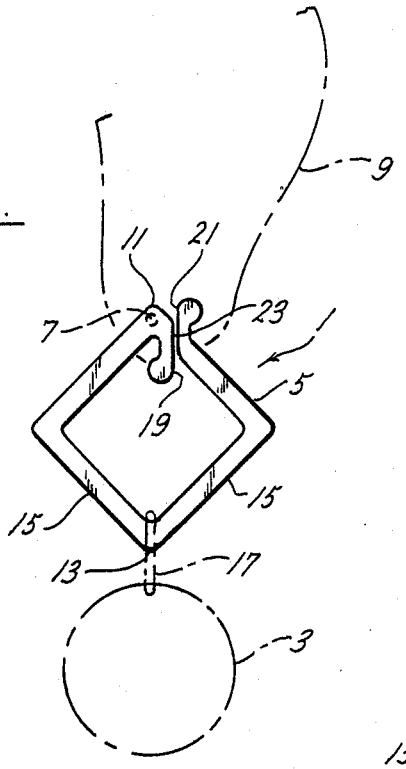
FIG. 3.
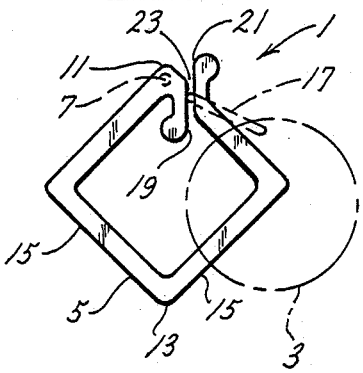
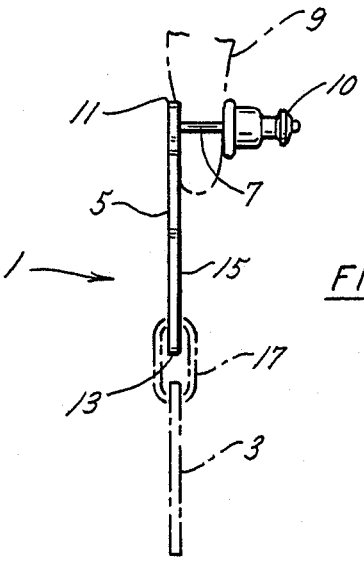
FIG. 2.

EARRING DEVICE FOR SUSPENDING A VARIETY OF CHARMS OR THE LIKE

BACKGROUND OF THE INVENTION

This invention relates generally to earrings, and more particularly to an earring for releasably suspending any of a variety of charms.

The popularity of charm bracelets has been decreasing in the past few years, in part due to the bulk and inconvenience of the bracelets, but also due to the fear of theft or robbery of a charm bracelet having many valuable charms attached thereto. Another cause of the declining popularity of charm bracelets may be the increasing participation in the wage-earning workforce of women who otherwise may be inclined to wear them. Many women leave their charm bracelets at home when they go to work because they are embarrassed by the noise caused by charms clanging against one another. In addition, charm bracelets tend to snag or become caught in office furniture, machinery, etc. Whatever the cause or causes of the reduced popularity may be, many people find they have more charms than they either wish or are able to use.

One alternative use of these charms would be to hang them from earrings. Hung from earrings, the charms would not interfere with workplace or other activities, the charms being in a position where they would not tend to snag or become caught in furniture, machinery, etc. One charm suspended from an ear, in addition to being less of an object of theft, would be less of a loss should the wearer be robbed than would an entire charm bracelet. Moreover, it has become fashionable recently to wear a different earring on each ear, and it would be desirable to be able to do the same with charms suspended from earrings.

Vaughn, U.S. Pat. No. 2,797,561 discloses an "earring with hook for removably attaching a pendant ornament". The earring includes a hook and a retaining plate, the lower portion of which is biased by a spring toward the hook to retain an ornament on the hook. While pendants may be interchangeably attached to the Vaughn earring, the structure includes a number of generally delicate or fragile parts, such as a hook, retaining plate and spring. These parts project forwardly from the ear of the wearer and may inadvertently snag various objects or become entangled with the wearer's hair. In addition to being fragile, these parts detract from the appearance of the earring while increasing its cost of manufacture.

Ritter, U.S. Pat. No. 4,086,786 discloses a "two part piercing earring with an ornament on each part". The earring includes a link optionally provided with a slot at the side of the link so that a connecting link of a charm may be removed therefrom. No means for closing the slot is disclosed.

SUMMARY OF THE INVENTION

Among the several objects of the invention may be noted the provision of an earring for suspending any of a variety of charms or the like; the provision of such an earring which is adapted to interchangeably and securely hold any of a variety of different charms; the provision of a pair of such earrings, from one of which may be suspended one kind of charm and from the other of which may be suspended another kind of charm; the provision of such an earring which is adapted to suspend a charm such that the plane of the charm is parallel to the plane of the wearer's ear lobe so that a specific surface of the charm faces forward; the provision of such an earring which can be economically manufactured of one contiguous piece of precious or semi-precious metal; the provision of such an earring which is durable and simple; and the provision of such an earring which is attractive and tasteful.

Generally, an earring of the present invention is useful for suspending any of a variety of charms or the like therefrom. The earring comprises a loop member and means on the backside of the loop member for attaching the loop member to an ear. The loop member has a generally narrow throat adapted for allowing a link of a charm to be pulled therethrough to attach or detach the charm to the earring, the throat being positioned along the loop member generally adjacent the attaching means so that the throat is closed by the ear of the wearer when the earring is attached to the ear, thereby to secure the charm to the loop.

In a second aspect of this invention, the earring comprises a loop member and means on the backside of the loop member for attaching the loop member to an ear. The loop member has a generally narrow throat at or adjacent the top of the loop member adapted for allowing a link of a charm to be pulled therethrough to attach or detach the charm to the earring. The loop member is spring-biased from an open position wherein the link of a charm may be passed through the throat toward a closed position wherein the throat is narrower than the link of a charm thereby to secure the charm to the loop member.

Other objects and features will be in part apparent and in part pointed out hereinafter.

BRIEF DESCRIPTION OF THE DRAWINGS

FIG. 1 is a front elevation of an earring of the present invention, showing the earring attached to an ear and a charm hanging from the earring;

FIG. 2 is a side view of the earring of FIG. 1; and

FIG. 3 is a view similar to FIG. 1, illustrating how a charm is attached to the earring.

Corresponding reference characters indicate corresponding parts throughout the several views of the drawings.

DESCRIPTION OF PREFERRED EMBODIMENTS

Now referring to the drawings, an earring of the present invention is designated in its entirety by the reference numeral 1. The earring 1 is designed for suspending any of a variety of charms 3 (shown in phantom) therefrom. The earring 1 is preferably formed of precious metal, such as gold or silver, according to the type of charm with which it is to be used.

As shown in FIGS. 1 and 2, the earring 1 comprises a one-piece loop member 5 forming only one loop bounding an open space, and a stem 7 integrally formed with the loop member and extending from the backside of the loop member for insertion through an opening in a pierced ear (shown in phantom at 9) to attach the loop member to the ear. As used herein, "integrally formed" means formed of or molded in one contiguous or continuous piece of material. It does not include mechanically fastening a number of different pieces together to form one assembly. For example, the stem 7 may be welded on the backside of the loop member 5. A crown or clasp ring 10 is provided for connection to the stem 7 to hold the earring 1 on the ear 9. It will be understood that stem 7 and clasp ring 10 constitute one means for attaching the loop member to an ear. Other suitable means for attaching the earring may also be used, such as conventional clamp-type mechanisms for non-pierced ears.

While a number of different configurations are contemplated, the loop member 5 shown in the drawings and described herein is generally planar and rectangular. Alternatively, the loop member may have a generally flower-shaped, four-leaf clover, heart-like, triangular, circular or diamond outline or configuration. Of course, other configurations, and planar or non-planar variations of these configurations, may also be used. Preferably, the stem 7 is mounted on and extends from the backside of a top corner 11 of the rectangular loop member 5. Bottom corner 13 and lower sides 15 of the loop member then form a V-shaped structure for holding a connecting link 17 (shown in phantom) of the charm 3.

As shown in FIG. 1, the loop member 5 has end portions 19 and 21 positioned adjacent one another adjacent the top corner 11 of the loop to form a generally narrow throat 23 therebetween. The throat 23 is adapted for allowing the link 17 of charm 3 to be pulled therethrough to attach or detach the charm to the earring 1.

Two distinct mechanisms may be provided for closing the throat 23 to secure the link 17 on the loop member 5. In the first, the throat 23 is positioned along the loop member 5 generally adjacent the stem 7 so that the throat is closed by the ear 9 of the wearer when the earring is attached to the ear. In addition to or in lieu of the first, the loop member 5 may be spring-biased toward a closed position (FIG. 1) wherein the throat is narrower than the link of a charm (e.g., end portion 19 being close to or engaging end portion 21) thereby to secure the charm to the loop member. To attach or remove the charm 3, the loop member 5 is movable to an open position (FIG. 3) by the link 17 of charm 3 as it is pushed or pulled through the throat 23. This may be accomplished by forming the loop member 5 of a generally resilient metal or metal alloy such that the loop member is in its closed position when unstressed. It will be understood that if the spring-bias mechanism is used alone, the throat 23 may be positioned on the loop member 5 at positions other than adjacent the stem 7. Preferably, both mechanisms are provided; that is, the throat 23 is so positioned along the loop member 5 that it is closed by the ear 9 of the wearer and the loop member 5 is spring-biased to close the throat. This is particularly desirable considering the precious and/or irreplaceable nature of many of the charms that may be used with the earring 1.

In addition, the earring 1 is preferably designed to hold the suspended charm 3 in a position wherein the charm tends to face forwardly with respect to the wearer so that the design of the charm is clearly visible to potential admirers. In the case of a charm having the single connecting link, such as link 17, the plane of the loop member 5 is adapted to be positioned generally parallel to the plane of the wearer's ear 9. The loop member 5 will be so positioned when, for example, the longitudinal axis of the stem 7 is generally perpendicular to the plane of the loop member. As shown in the drawings, the connecting link 17 will tend to move to a position where the plane of the link is perpendicular to the plane of the loop member 5. At the same time, the charm 3 will tend to move to a position where the plane of the charm is perpendicular to the plane of the connecting link 17. At this position, the charm 3 is generally parallel to the plane of the loop member 5, and, thus, parallel to the plane of the wearer's ear.

To change one charm for another, the earring 1 is first removed from the wearer's ear 9. The old charm is removed from the loop member 5 by pulling the connecting link 17 outwardly through the throat 23. The amount of force required to pull the link 17 through the throat will vary according to the spring-bias of the loop member 5. The connecting link 17 of the new selected charm 3 is then pulled inwardly through the throat 23, and the earring 1 is attached to the ear 9. It will be observed that the wearer can select a different type of charm for each ear while wearing identical earrings 1 on both ears. In addition, the earring 1 can be used to hold charms of the type frequently used on bracelets or most any other charm which is attractive and/or of sentimental value to the wearer.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An earring for suspending any of a variety of charms or the like therefrom, the earring comprising a loop member forming only one loop bounding an open space, and means on the backside of the loop member for attaching the loop member to an ear, the loop member having a generally narrow throat adapted for allowing a link of a charm to be pulled therethrough into said open space to attach or detach the charm to the earring, the throat being positioned along the loop member generally adjacent said attaching means so that the throat is closed by the ear of the wearer when the earring is attached to the ear, thereby to secure the charm to the loop, said loop member being spring-biased from an open position wherein the link of a charm may be passed through the throat into said open space toward a closed position wherein the throat is narrower than the link of a charm thereby to secure the charm to the loop member.

2. An earring as set forth in claim 1 wherein the throat is adjacent the top of the loop.

3. An earring as set forth in claim 1 wherein said attaching means comprises a stem extending from the backside of the loop member for insertion through an opening in a pierced ear.

4. An earring as set forth in claim 1 wherein the loop member has end portions positioned adjacent one another to form said throat therebetween.

5. An earring as set forth in claim 1 wherein the loop member is generally planar.

6. An earring as set forth in claim 5 wherein the attaching means is adpated for holding the plane of the loop member generally parallel to the plane of the wearer's ear.

7. An earring as set forth in claim 6 wherein the loop member is generally rectangular and has end portions positioned adjacent one another to form said throat therebetween.

8. An earring as set forth in claim 5 wherein the loop member is adapted for holding a planar charm having a single connecting link, the plane of the link being generally perpendicular to the plane of the charm, said attaching means being adapted for holding the loop member in a plane generally parallel to the plane of the wearer's ear so that the connecting link will tend to hang in a plane generally perpendicular to the plane of the wearer's ear whereby the charm will tend to hang in a plane generally parallel to the plane of the wearer's ear.

9. An earring for suspending any of a variety of charms or the like therefrom, the earring comprising a loop member forming only one loop bounding an open space, and means on the backside of the loop member for attaching the loop member to an ear, the loop member having a generally narrow throat at or adjacent to the top of the loop member adapted for allowing a link of a charm to be pulled therethrough into said open space to attach or detach the charm to the earring, the loop member being spring-biased from an open position wherein the link of a charm may be passed through the throat into said open space toward a closed position wherein the throat is narrower than the link of a charm thereby to secure the charm to the loop member, the throat being positioned along the loop member generally adjacent said attaching means so that the throat is closed by the ear of the wearer when the earring is attached to the ear.

10. An earring for suspending any of a variety of charms or the like therefrom, the earring comprising a generally planar loop member forming only one loop bounding an open space, and means on the backside of the loop member for attaching the loop member to an ear, the loop member having a generally narrow throat at or adjacent to the top of the loop member adapted for allowing a link of a charm to be pulled therethrough into said open space to attach or detach the charm to the earring, the loop member being spring-biased from an open position wherein the link of a charm may be passed through the throat into said open space toward a closed position wherein the throat is narrower than the link of a charm thereby to secure the charm to the loop member, the attaching means being adapted for holding the loop member in a plane generally parallel to the plane of the wearer's ear.

11. An earring as set forth in claim 10 wherein the loop member is generally rectangular and has end portions positioned adjacent to one another to form said throat therebetween.

12. An earring for suspending any of a variety of charms or the like therefrom, the earring comprising a generally planar loop member forming only one loop bounding an open space, and means on the backside of the loop member for attaching the loop member to an ear, the loop member having a generally narrow throat at or adjacent to the top of the loop member adapted for allowing a link of a charm to be pulled therethrough into said open space to attach or detach the charm to the earring, the loop member being spring-biased from an open position wherein the link of a charm may be passed through the throat into said open space toward a closed position wherein the throat is narrower than the link of a charm thereby to secure the charm to the loop member, the loop member being adapted for holding a planar charm having a single connecting link, the plane of the link being generally perpendicular to the plane of the charm, said attaching means being adapted for holding the loop member in a plane generally parallel to the plane of the wearer's ear so that the connecting link will tend to hang in a plane generally perpendicular to the plane of the wearer's ear whereby the charm will tend to hang in a plane generally parallel to the plane of the wearer's ear.

13. An earring for suspending any of a variety of charms or the like therefrom, the earring comprising:

a single generally planar loop member bounding an open space, the ends of the loop member defining a narrow throat therebetween adapted for allowing a link of a charm to be pulled therethrough into the open space, said loop member being spring-biased from an open position wherein the link of a charm may be passed through the throat into said open space toward a closed position wherein the throat is narrower than the link of a charm thereby to secure the charm to the loop member; and means on the backside of the loop member adjacent the throat for attaching the loop member to an ear with the throat of the loop held securely against the front of the ear to prevent the link from passing through the throat of the loop while the loop is attached to an ear.

* * * * *